US008845829B2

(12) United States Patent
Aoyama et al.

(10) Patent No.: US 8,845,829 B2
(45) Date of Patent: Sep. 30, 2014

(54) CU ALLOY MATERIAL, METHOD OF MANUFACTURING CU ALLOY CONDUCTOR USING THE SAME, CU ALLOY CONDUCTOR OBTAINED BY THE METHOD, AND CABLE OR TROLLEY WIRE USING THE CU ALLOY CONDUCTOR

(75) Inventors: Seigi Aoyama, Tokyo (JP); Takaaki Ichikawa, Tokyo (JP); Hiroyoshi Hiruta, Tokyo (JP); Hiromitsu Kuroda, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 611 days.

(21) Appl. No.: 12/716,766

(22) Filed: Mar. 3, 2010

(65) Prior Publication Data

US 2010/0163139 A1 Jul. 1, 2010

Related U.S. Application Data

(62) Division of application No. 10/970,717, filed on Oct. 22, 2004, now abandoned.

(30) Foreign Application Priority Data

Oct. 24, 2003 (JP) ..... 2003-365234
Jul. 20, 2004 (JP) ..... 2004-211603

(51) Int. Cl.
*C22C 9/02* (2006.01)
*C22F 1/08* (2006.01)
*B60M 1/13* (2006.01)

(52) U.S. Cl.
CPC .... *C22C 9/02* (2013.01); *C22F 1/08* (2013.01)
USPC ..... 148/554; 148/571; 148/577; 148/680; 148/681; 148/684

(58) Field of Classification Search
USPC ..... 148/554, 577, 680, 681, 684, 517
See application file for complete search history.

(56) References Cited

U.S. PATENT DOCUMENTS 2,947,069 A * 8/1960 Carlson et al. ..... 428/629
5,882,442 A * 3/1999 Caron et al. ..... 148/433
2002/0006351 A1* 1/2002 Sugawara et al. ..... 420/477

FOREIGN PATENT DOCUMENTS

CN 1572892 A 2/2005
JP 59-43332 B2 10/1984

(Continued)

OTHER PUBLICATIONS

S. Aoyama et al., U.S. PTO Office Action, U.S. Appl. No. 10/970,717, dated Jan. 2, 2008, 9 pages.

(Continued)

*Primary Examiner* — Sikyin Ip
(74) *Attorney, Agent, or Firm* — Foley & Lardner LLP

(57) ABSTRACT

A method of manufacturing a Cu alloy conductor includes the steps of:

adding and dissolving In of 0.1-0.7 weight % to a Cu matrix containing oxygen of 0.001-0.1 weight % (10-1000 weight ppm) to form a molten Cu alloy, performing a continuous casting with the molten Cu alloy, rapidly quenching a casting material to a temperature by at least 15° C. or more lower than a melting point of molten Cu alloy, controlling the casting material at a temperature equal to or lower than 900° C., and performing a plurality of hot rolling processes to the casting material such that a temperature of a final hot rolling is within a range of from 500 to 600° C. to form the rolled material.

6 Claims, 9 Drawing Sheets

(56) References Cited

FOREIGN PATENT DOCUMENTS

| | | | | |
|---|---|---|---|---|
| JP | 61-136648 | A | | 6/1986 |
| JP | 64-012538 | A | | 1/1989 |
| JP | 3-024241 | A | | 2/1991 |
| JP | 4-180531 | A | | 6/1992 |
| JP | 6-240388 | A | | 8/1994 |
| JP | 6-240426 | A | | 8/1994 |
| JP | 06240385 | A | * | 8/1994 |
| JP | 10-102165 | A | | 4/1998 |
| JP | 2001-316741 | A | | 11/2001 |
| JP | 2002-025353 | A | | 1/2002 |
| JP | 2004-137551 | A | | 5/2004 |
| JP | 2005-029884 | A | | 2/2005 |

OTHER PUBLICATIONS

S. Aoyama et al., U.S. PTO Final Office Action, U.S. Appl. No. 10/970,717, dated Sep. 18, 2008, 9 pages.

S. Aoyama et al., U.S. PTO Advisory Action, U.S. Appl. No. 10/970,717, dated Jan. 29, 2009, 4 pages.

S. Aoyama et al., U.S. PTO Office Action, U.S. Appl. No. 10/970,717, dated May 13, 2009, 9 pages.

S. Aoyama et al., U.S. PTO Office Action, U.S. Appl. No. 10/970,717, dated Jun. 11, 2009, 9 pages.

S. Aoyama et al., U.S. PTO Final Office Action, U.S. Appl. No. 10/970,717, dated Jan. 6, 2010, 9 pages.

* cited by examiner

51
CRYSTAL STRUCTURE

52
CRYSTAL STRUCTURE

CU ALLOY MATERIAL, METHOD OF MANUFACTURING CU ALLOY CONDUCTOR USING THE SAME, CU ALLOY CONDUCTOR OBTAINED BY THE METHOD, AND CABLE OR TROLLEY WIRE USING THE CU ALLOY CONDUCTOR

CROSS-REFERENCE TO RELATED APPLICATIONS

The present application is a Divisional of U.S. Ser. No. 10/970,717, filed Oct. 22, 2004, now abandoned, which is based on Japanese patent applications No. 2003-365234 and No. 2004-211603, the entire contents of which are incorporated herein by reference.

BACKGROUND OF THE INVENTION

1. Field of the Invention

The present invention relates to a Cu alloy material of high conductivity and high strength used in a Cu alloy conductor for an electric overhead wire (a trolley wire) which transmits electric power to a train through a pantograph or the like, or in a Cu alloy conductor for a cable which is used in devices or the like, and a method of manufacturing a Cu alloy conductor using the same.

2. Background of the Related Art

In a Cu alloy conductor for an electric overhead wire (trolley wire) or a Cu alloy conductor for a cable which is used in devices or the like, a hard Cu wire of high conductivity or a Cu alloy material (a Cu alloy wire) of wear resistance and heat resistance is used. The material known as a Cu alloy material is a Cu matrix with Sn of 0.25-0.35 weight % contained (refer to Japanese Examined Patent Publication No. 59-43332), which is used as a trolley wire of a bullet train or a conventional railway line.

In recent years, the further speedup of a train has been developed. This speedup requires a higher tension of an overhead trolley wire, and the tension of the electric overhead wire tends to be increased from 1.5t to 2.0t or more. Therefore, there is a demand for a trolley wire with sufficient strength against the high tension. Moreover, a large current capacity of the trolley wire is required in a railway track having a high train-passing density (the number of trains passing in a railway track per unit length).

Additionally, a cable for an instrument is desirably a conductor of high flexibility in terms of the environment to be used, that is, a conductor of high strength. A cable for an instrument is also desirably a conductor of high electric conductivity to satisfy the demands for a lighter and smaller cable.

Therefore, a Cu alloy conductor of high strength and high electric conductivity is required as a conductor to satisfy the demands described above.

As Cu alloy conductors of high strength, there are mainly two alloys such as a solid solution-strengthening alloy and a precipitation-strengthening alloy. As the solid solution-strengthening alloy, there is a Cu—Ag alloy (a silver of high concentration), a Cu—Sn alloy, a Cu—Sn—In alloy, a Cu—Mg alloy, a Cu—Sn—Mg alloy or the like. As the precipitation-strengthening alloy there is a Cu—Zr alloy, a Cu—Cr alloy, a Cu—Cr—Zr alloy or the like.

Since each of the solid solution-strengthening alloys contains oxygen of 10 weight ppm or less (0.001 weight % or less), and is superior in elongation characteristic as well as strength, it is possible to directly manufacture a Cu alloy roughing wire which is a base material of a trolley wire from the molten Cu alloy through a continuous casting and rolling process.

In a method of manufacturing a conventional trolley wire using a solid solution-strengthening alloy, for instance, a casting material of a Cu alloy which contains Sn of 0.4-0.7 weight % is hot-rolled at a temperature equal to or lower than 700° C. to produce a rolled material. There is a method of manufacturing a trolley wire by performing a finished rolling process to the rolled material at a temperature equal to or lower than 500° C. once again and through a heat treatment process to produce a roughing wire, and then, by performing the roughing wire to a wire-drawing process (refer to Japanese Unexamined Patent Publication No. 6-240426)

In addition, as another Cu alloy capable of a continuous casting and rolling, there is a Cu—O—Sn alloy. In this alloy, Sn exists as 2-3 μm crystallized particles ($SnO_2$) inside of the matrix thereof, and it is noted that the strength and elongation characteristics of this alloy are equivalent to those of a Cu—Sn alloy containing oxygen content of 10 ppm or less by weight. This alloy also has a stronger effect of solid solution-strengthening than an effect of precipitation strengthening or of dispersion strengthening.

As a solid solution-strengthening alloy contains more contents of solid solution-strengthening elements, the alloy can improve strength the more. However, as the electric conductivity extremely decreases with more elements contained in the alloy, it is impossible to increase the current capacity, and as a result the alloy is not appropriate for use of an electric overhead wire. In the method of manufacturing a Cu alloy according to Japanese Unexamined Patent Publication No. 6-240426, for instance, Sn content contained in the alloy is 0.4-0.7 weight %, which is a large amount, and accordingly the electric conductivity is decreased. Therefore, it is difficult to manufacture a Cu alloy conductor with strength required in a high-tension overhead wire, as well as with superior electric conductivity by the present Cu—Sn alloy.

At this point, it is assumed that an electric overhead wire of high strength and high electric conductivity is obtained by adding another element with Sn. In this case, there are problems that when a temperature of finish rolling (final rolling) is too low, for example 500° C., a rolled material is often broken in a rolling process and the appearance quality of a roughing wire is extremely low and therefore the strength of an electric overhead wire becomes extremely low.

On the contrary, a precipitation-strengthening alloy has a high degree of hardness and a high tensile strength, but in a continuous casting and rolling process, such high degree of the hardness applies excessive load to a mill roll, which does not allow a manufacture by continuous casting and rolling. This alloy can be manufactured only in a batch type by extrusion or the like. Additionally, the precipitation-strengthening alloy needs a heat treatment in order to separate a precipitation-strengthening material out in the intermediate process. The precipitation-strengthening alloy has problems with low productivity and high manufacturing cost, as compared to a solid solution-strengthening alloy which can be manufactured by a continuous casting and rolling process.

Namely there are restrictions and limitations in manufacturing a Cu alloy conductor of high strength and high electric conductivity by using a method of continuous casting and rolling, which is excellent in productivity.

SUMMARY OF THE INVENTION

It is an object of the invention to provide a Cu alloy material that has high electric conductivity and high strength.

It is a further object of the present invention to provide a method of manufacturing a Cu alloy conductor using the same.

It is a further object of the present invention to provide a Cu alloy conductor obtained by the method; and It is a further object of the present invention to provide a cable or a trolley wire using the Cu alloy conductor.

According to a first aspect of the present invention, a Cu alloy material comprises a Cu matrix containing oxygen of 0.001-0.1 weight % (10-1000 weight ppm), Sn of 0.1-0.4 weight %, and at least a kind of an additive element of 0.01-0.7 weight % having a larger affinity with oxygen than the Sn, wherein a ratio of a sum of the Sn and the additive element is 0.3-0.8 weight %.

The additive element may preferably contain at least a kind of an element to be selected out of Ca, Mg, Li, Al, Ti, Si, V, Mn, Zn, In or Ag, or a compound thereof.

The Cu matrix may preferably, besides the Sn and the additive element, contain P or B equal to or less than 0.01 weight % (100 weight ppm).

The Cu matrix may preferably, besides the Sn and the additive element, contain a sum of P and B equal to or less than 0.02 weight % (200 weight ppm).

According to a second aspect of the present invention, a method of manufacturing a Cu alloy conductor with use of a rolled material formed in a continuous casting and rolling process by using a molten Cu alloy, comprises the steps of:

adding and dissolving Sn of 0.1-0.4 weight %, and at least a kind of an additive element of 0.01-0.7 weight % having a larger affinity with oxygen than the Sn, wherein a ratio of a sum of the Sn and the additive element of 0.3-0.8 weight %, to a Cu matrix containing oxygen of 0.001-0.1 weight % (10-1000 weight ppm) to form the molten Cu alloy;

performing a continuous casting with the molten Cu alloy, as well as rapidly quenching a casting material to a temperature at least 15° C. lower than a melting point of the molten Cu alloy;

controlling the casting material at a temperature equal to or lower than 900° C.; and performing a plurality of hot rolling processes to the casting material such that a temperature of a final hot rolling is within a range of from 500 to 600° C. to form the rolled material.

It is preferable to form the Cu alloy conductor by performing a cold work to the rolled material at a temperature within a range of from −193 to 100° C. in a degree of the processing equal to or more than 50%.

According to a third aspect of the present invention, a Cu alloy conductor comprises:

a Cu alloy material, comprising:

a Cu matrix containing oxygen of 0.001-0.1 weight % (10-1000 weight ppm), Sn of 0.1-0.4 weight %, and at least a kind of an additive element of 0.01-0.7 weight % having a larger affinity with oxygen than the Sn, wherein a ratio of a sum of the Sn and the additive element is 0.3-0.8 weight %, wherein:

an average particle diameter of crystal particles forming a crystal structure is equal to or less than 100 μm; and 80% or more of oxides of an element having the largest affinity with oxygen out of the additive elements is dispersed in a crystal structure matrix as micro oxides an average particle diameter of which is equal to or 1 μm.

The Cu alloy conductor may preferably have tension strength that is equal to or more than 420 MPa, and the electric conductivity that is equal to or more than 60% IACS.

A cable comprises an insulating layer disposed around a single-track material or a twisted wire material made of the Cu alloy conductor according to the third aspect.

According to a fourth aspect of the present invention, a Cu alloy material comprises a Cu matrix containing oxygen of 0.001-0.1 weight % (10-1000 weight ppm), wherein In of 0.1-0.7 weight % is contained.

The Cu matrix may contain P or B of equal to or less than 0.01 weight % (100 weight ppm) in addition to the In.

Moreover, the Cu alloy material may contain a sum of P and B, which is equal to or less than 0.02 weight % (200 weight ppm) in addition to the In.

According to a fifth aspect of the present invention, a method of manufacturing a Cu alloy conductor with use of a rolled material formed in a continuous casting and rolling process by using a molten Cu alloy, comprises the steps:

adding and dissolving In of 0.1-0.7 weight % to a Cu matrix containing oxygen of 0.001-0.1 weight % (10-1000 weight ppm) to form the molten Cu alloy;

performing a continuous casting with the molten Cu alloy, as well as rapidly quenching casting material to a temperature at least 15° C. lower than a melting point of the molten Cu alloy;

controlling the casting material at a temperature equal to or lower than 900° C.; and performing a plurality of hot rolling processes to the casting material such that a temperature of a final hot rolling is within a range of from 500 to 600° C. to form the rolled material.

It is preferable to form the Cu alloy conductor by performing a cold work to the rolled material at a temperature within a range of from −193 to 100° C. in a degree of the processing equal to or more than 50%.

According to a sixth aspect of the present invention, a Cu alloy conductor, comprises:

a Cu alloy material including In of 0.1-0.7 weight % in a Cu matrix containing oxygen of 0.001-0.1 weight % (10-1000 weight ppm), wherein:

an average particle diameter of crystal particles forming a crystal structure is equal to or less than 100 μm; and 80% or more of oxides of the In is dispersed in a crystal structure matrix as micro oxides an average particle diameter of which is equal to or less than 1 μm.

The Cu alloy conductor may preferably have the tensile strength that is equal to or more than 420 MPa, and the conductivity that is equal to or more than 60% IACS.

The Cu alloy conductor may preferably have the tensile strength that is equal to or more than 420 MPa, and the conductivity that is equal to or more than 75% IACS.

A cable comprises an insulating layer disposed around a single-track material or a twisted wire material made of the Cu alloy conductor according to the six aspect.

A trolley wire comprises the Cu alloy conductor according to the sixth aspect.

Advantages of the Invention

According to the present invention, a Cu alloy conductor of high strength and high electric conductivity can be advantageously obtained with high productivity.

These and other objects, features, aspects and advantages of the present invention will become apparent to those skilled in the art from the following detailed description, which, taken in conjunction with the annexed drawings, discloses a preferred embodiments of the present invention.

BRIEF DESCRIPTION OF THE DRAWINGS

The preferred embodiments according to the invention will be explained below referring to the drawings, wherein.

DETAILED DESCRIPTION OF THE PREFERRED EMBODIMENT

First Preferred Embodiment

Figure 1:
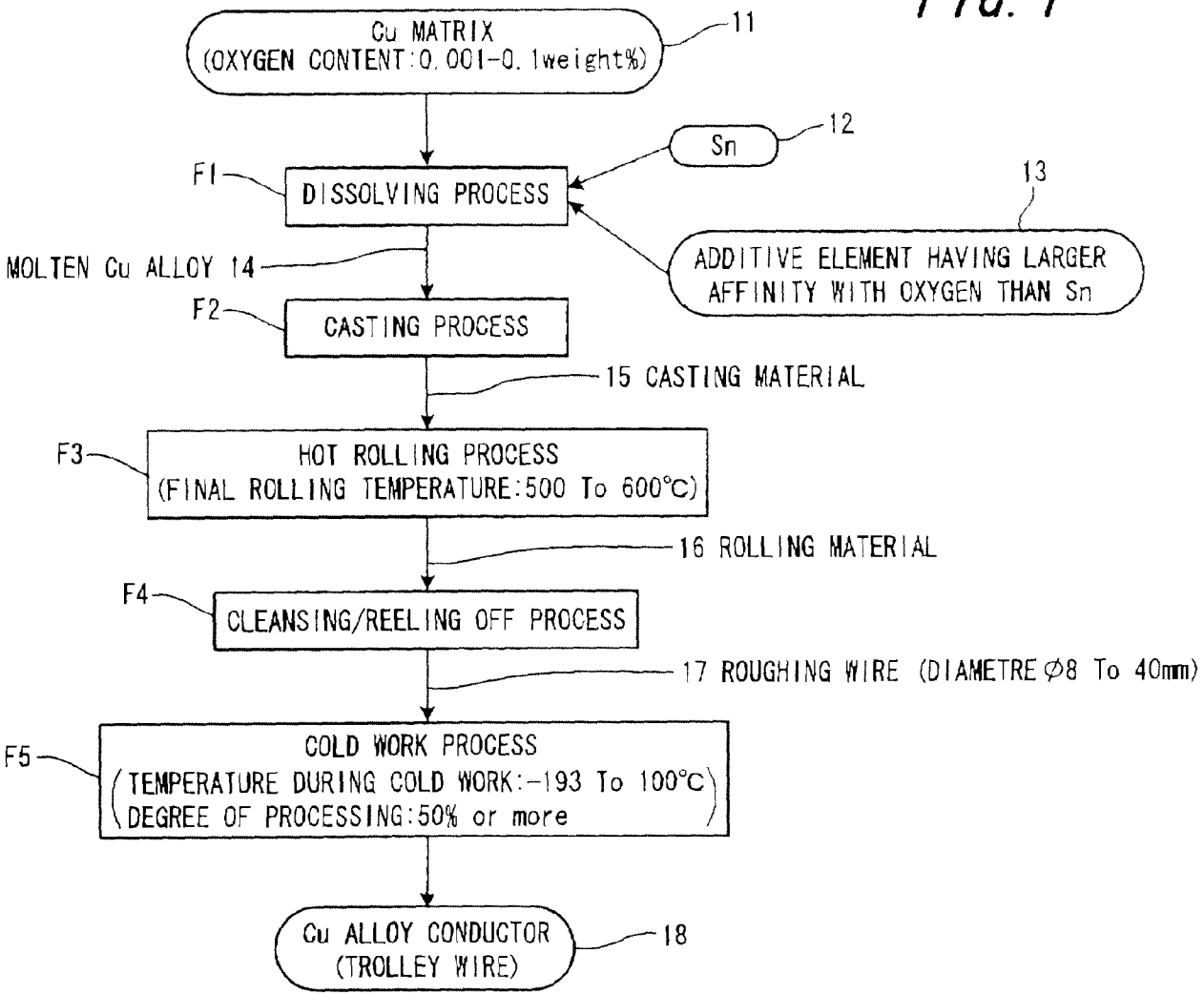
FIG. 1 is a flow chart showing a manufacturing process of a Cu alloy conductor in a first preferred embodiment according to the present invention.

FIG. 1 is a flow chart showing processes (steps) of manufacturing a copper alloy conductor in a first preferred embodiment of the present invention.

A method of manufacturing a Cu alloy conductor 18 in the first preferred embodiment comprises:

a dissolving process (step) for adding and dissolving Sn 12 and an additive element 13 to a Cu matrix 11 to form a molten Cu alloy 14 (F1);

a casting process (step) for casting the molten Cu alloy 14 to form a casting material 15 (F2);

a hot rolling process (step) for performing a plurality of hot rolling processes to the casting material 15 to form a rolled material 16 (F3);

a cleansing/reeling off process (step) for cleansing and reeling off the rolled material 16 to produce a roughing wire (F4); and a cold work (wire-drawing) process (step) for winding off the reeled roughing wire 17 and performing a cold work to the reeled roughing wire 17 to form a Cu alloy conductor 18 (F5).

The Cu alloy conductor 18 is processed to be a wire material or a plate material in a desired shape in accordance with its application. An existing or a conventional continuous casting rolling facility (SCR continuous casting machine) can be applied from the dissolving process (F1) to the cleansing/reeling off process (F4). And an existing or a conventional cold work machine can be applied to the cold work process (F5).

The method of manufacturing the Cu alloy conductor 18 will be explained in more detail as follows.

First, in the dissolving process (F1), Sn of 0.1-0.4 weight %, preferably 0.25-0.35 weight %, at least a kind of additive element of 0.01-0.7 weight %, preferably 0.01-0.6 weight % having a larger affinity with oxygen than the Sn, and a sum of the Sn and the additive element of 0.3-0.8 weight %, are added and dissolved to a Cu matrix containing oxygen of 0.001-0.1 weight % (10-1000 ppm by weight) to form a molten Cu alloy. Since the additive element 13 is an element which has a large affinity with oxygen, the additive element 13 is oxidized with a priority to Sn 12.

As a result, most (more than 80%) of oxides generated and dispersed in the crystal structure of a finally obtained Cu alloy conductor 18 become oxides of the additive elements and Sn oxides are hardly generated or dispersed. Accordingly most of the added Sn 12 are alloyed with Cu to form a matrix of the Cu alloy conductor.

Herein at least a kind of the additive element 13 having a large chemical attraction with $O_2$ is a kind of element or a compound selected out of Ca, Mg, Li, Al, Ti, Si, V, Mn, Zn, In, or Ag, preferably out of Ca, Mg, Al, or Ag.

In a case where a total content of Sn 12 and the additive element is less than 0.3 weight %, even if the manufacturing method according to the preferred embodiment is applied, an improvement in strength of the Cu alloy conductor is not achieved. And in a case where the total content thereof goes beyond 0.8 weight %, hardness of the casting material 15 is increased to increase a deformation resistance during rolling processing. As a result, a load to the rolling work becomes extremely high, which causes difficulty in commercialization of product.

Therefore, in the preferred embodiment the total content of Sn 12 and the additive element 13 is appropriately adjusted within the range of 0.3-0.8 weight %. As a result, as will be described in Example 1 later, a tension strength of the Cu alloy conductor increases to 420 MPa or more, as well as the conductivity can be adjusted properly within the range of 60-90% IACS.

As the total content of the Sn 12 and the additive element 13 increases, surface flaws of the rolling material 16 tend to increase in hot rolling during the hot rolling process (F3). Accordingly in the case of many total contents of Sn 12 and the additive element 13 (for example, 0.5 weight % or more), Sn 12 and the additive element 13, as well as P may be added to the Cu matrix 11 to reduce the surface flaws of the rolling material 16. P is added in a ratio equal to or less than 0.01 weight % (100 weight ppm). when the P content is less than 2 ppm, an effect of reducing the surface flaws of Cu wires is not obtained clearly and on the other hand, when the P content goes beyond 100 weight ppm, conductivity of the Cu alloy conductor 18 reduces.

As the total content of Sn 12 and the additive element 13 increase, a crystal particle of the casting material 15 after a casting process (F2) tends to become large in size (as a result, tendency to slight reduction in strength of the Cu alloy conductor 18). Hence, in a case many total contents of the Sn 12 and the additive element 13 are contained (in the case of 0.5 weight % or more), the Sn 12 and the additive element 13, as well as B may be added to the Cu matrix 11 to reduce sizes of crystal particles of the casting material 15 to be extremely small. B is added in a ratio equal to or less than 0.01 weight % (100 weight ppm). when the B content is less than 2 ppm, an effect of reducing the sizes of the crystal particles to be extremely small (as a result, an improvement effect of strength of the Cu alloy conductor 18) can not be obtained sufficiently and on the other hand, the B content goes beyond 100 weight ppm, conductivity of the Cu alloy conductor 18 reduces.

Further, both P and B may be added in a sum of 0.02 weight % (200 weight ppm).

Next, in the casting process (F2) the molten Cu ally 14 obtained in the previous process is provided to an SCR type of continuous casting rolling. In detail, a casting is performed at a temperature lower than a normal casting temperature (1120-1200° C.) in the SCR continuous casting, as well as a casting mold (Cu casting mold) is forcibly cooled, which rapidly cools the casting material 15 to a temperature at least 15° C. lower than a solidification temperature of the molten Cu alloy 14.

By these casting treatment and rapid cooling treatment, a size of oxides crystallized (or precipitated) in the casting material 15 and a crystal particle size of the casting material 15 are respectively smaller as compared to a case where a casting is performed at a normal casting temperature or where the casting material 15 is cooled only to a temperature exceeding a solidification temperature −15° C. of the molten Cu alloy 14.

Next, in the hot rolling process (F3) a temperature of the casting material 15 is controlled to a temperature 50-100° C. lower than a normal rolling temperature during continuous casting rolling, namely a temperature equal to or less than 900° C., preferably 750-900° C. In the state a plurality of hot rolling processes are performed to the casting material 15 and in a final rolling process a hot rolling work is performed at a temperature of from 500 to 600° C. to form the rolled material. When the final rolling temperature is less than 500° C., many surface flaws are produced during the rolling process, which causes deterioration of surface quality in the casting material 15. When the final rolling temperature is more than 600° C., the crystal structure becomes a rough structure in the same level as the conventional structure.

Due to the hot rolling the oxides in a relatively small size crystallized (or precipitated) in the previous process are separated, thereby to reduce the size of the oxides smaller. And since the hot rolling process in the manufacturing method according to the present embodiment is performed at a temperature lower than in a normal hot rolling, the dislocation introduced during the rolling is rearranged to form a very small sub-boundary in the crystal particle (Sub-boundary; refer to FIG. 3B). A sub-boundary is a boundary between a plurality of crystals existing in the crystal particle a direction of which is a little different.

Next, in the cleansing/reeling off process (F4) the rolling material 16 is cleansed and reeled off to form the roughing wire 17. A wire diameter of the reeled roughing wire 17 is set as, for example 8-40 mm, preferably equal to or less than 30 mm. For example, a wire diameter of the roughing wire 17 for a trolley line is set as 22-30 mm.

Finally, in a cold work process, the reeled wire 17 is wound off and a cold work (wire processing) is performed at a temperature of −193 (liquid nitrogen temperature)-100° C., preferably less than −193-25° C. Thereby, the Cu alloy conductor 18 is formed. Herein, in order to reduce an influence (deterioration of strength) of heat generated during a continuous wiring on the Cu alloy conductor 18, cooling a cold work device such as a drawing die is performed, to adjust a wire material temperature to be equal to or less than 100° C., preferably 25° C. or less. And in order to improve the strength of the Cu alloy conductor 18, it is necessary to sufficiently increase the strength of the rolling material 16, namely the roughing wire 17, by increasing a degree of processing in a hot rolling work. Besides, the degree of processing is required to be equal to or more than 50%. When the degree of processing is less than 50%, tension strength exceeding 420 MPa cannot be obtained.

Figure 2:
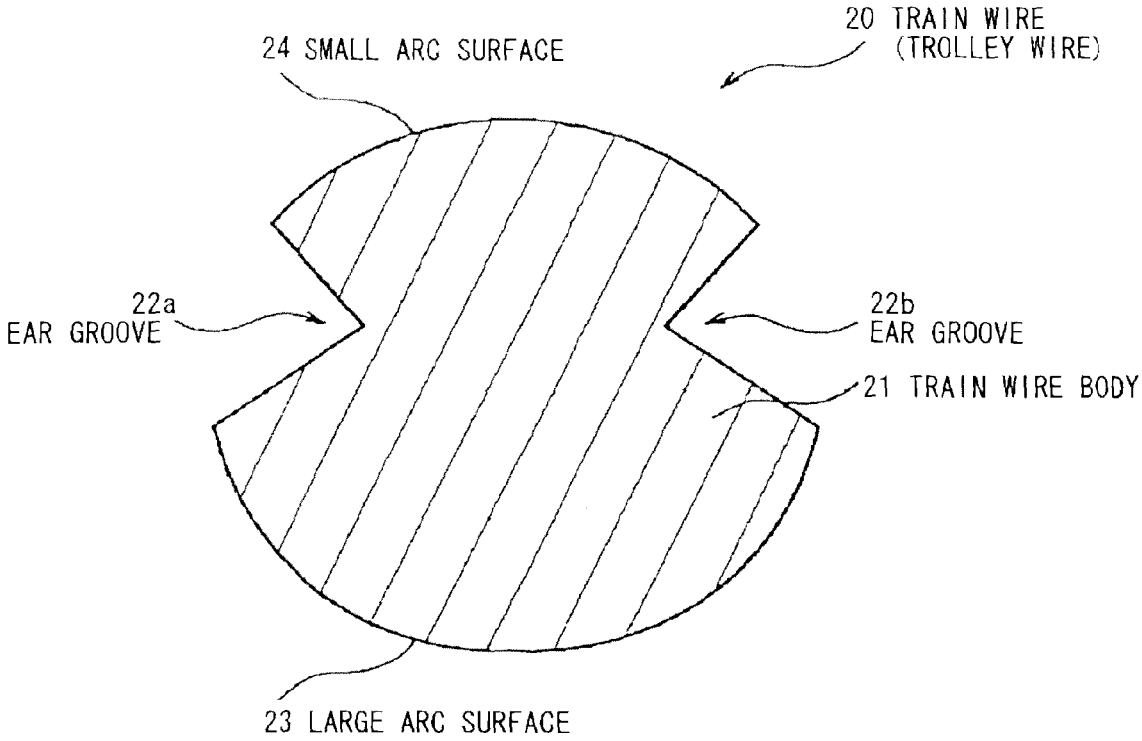
FIG. 2 is a transverse sectional view showing a trolley wire using the Cu alloy conductor in the first preferred embodiment according to the present invention.

FIG. 2 shows a trolley wire using a Cu alloy conductor 18 in the preferred embodiment. The Cu alloy conductor 18 produced is formed to be in a desired shape suitable for a train wire (trolley wire) 20. The train wire is composed of a train wire body 21 on both sides of which ear grooves 22*a*, 22*b* for mounting a dropper ear are formed. An outer surface in the lower side of the train wire body 21 is formed in a large arc surface 23 as a portion where a pantograph for train slides, and an outer surface in the upper side of the train wire body 21 is formed to be in a small arc surface. A cross sectional area of the train 20 is, for example, 110-170 $mm^2$.

Next, operations of the preferred embodiment will be explained.

Figure 4:
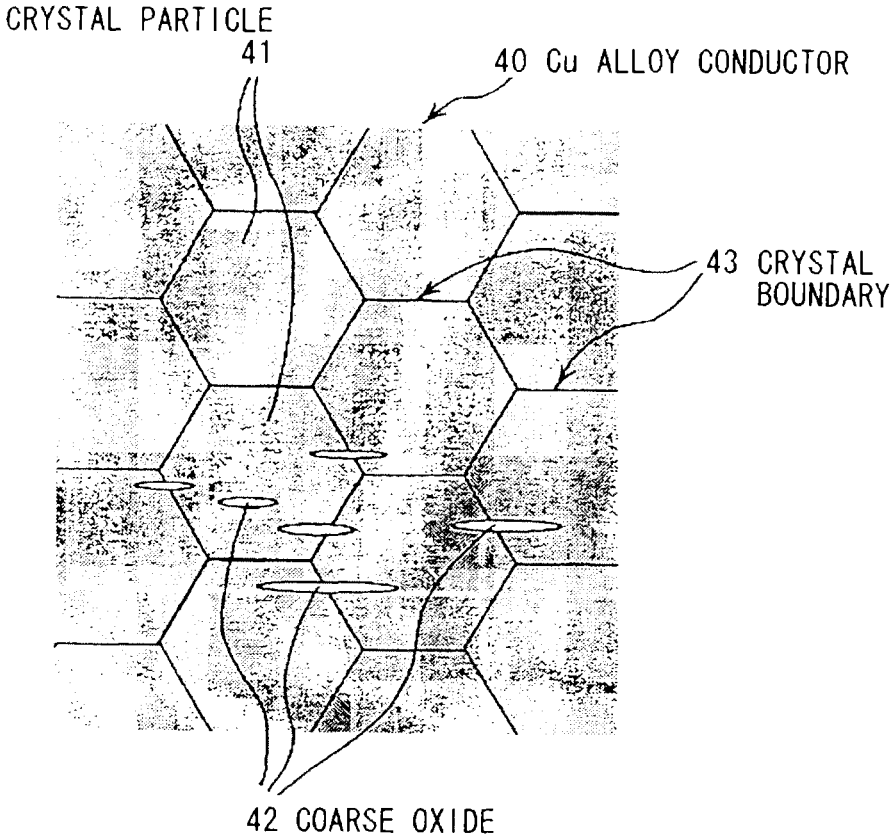
FIG. 4 is a pattern diagram showing a crystal structure in a Cu alloy conductor of the related art.

FIG. 4 shows a conventional Cu alloy conductor 40. A crystal structure of the conventional Cu alloy conductor 40 is coarse, namely the crystal particle 41 thereof is coarse. And an oxide such as Sn is a coarse oxide 42 having an average particle diameter (or length) more than 1 μm. The oxide is not in a crystal boundary 43 of each crystal particle 41 and is dispersed in the crystal structure at a random. Resultantly the tension strength of the conventional Cu alloy conductor 40 is not sufficient.

On the other hand, in a method of manufacturing a Cu alloy conductor 18 according to the preferred embodiment, a Sn content of 0.1-0.4 weight %, at least a kind of additive element of 0.01-0.7 weight %, and a sum of Sn content and the additive element of 0.3-0.8 weight %, are added and dissolved to a Cu matrix 11 to form a molten Cu alloy. Thereafter, a continuous casting at a low temperature (a casting temperature of 1100-1150° C.), a low temperature rolling work (a final rolling temperature of 500-600° C.), and a cold work at a temperature adjusted to be equal to or less than 100° C. to avoid an influence of work heat are performed to the molten Cu alloy 14 to form the Cu alloy conductor 18.

Figure 3A:
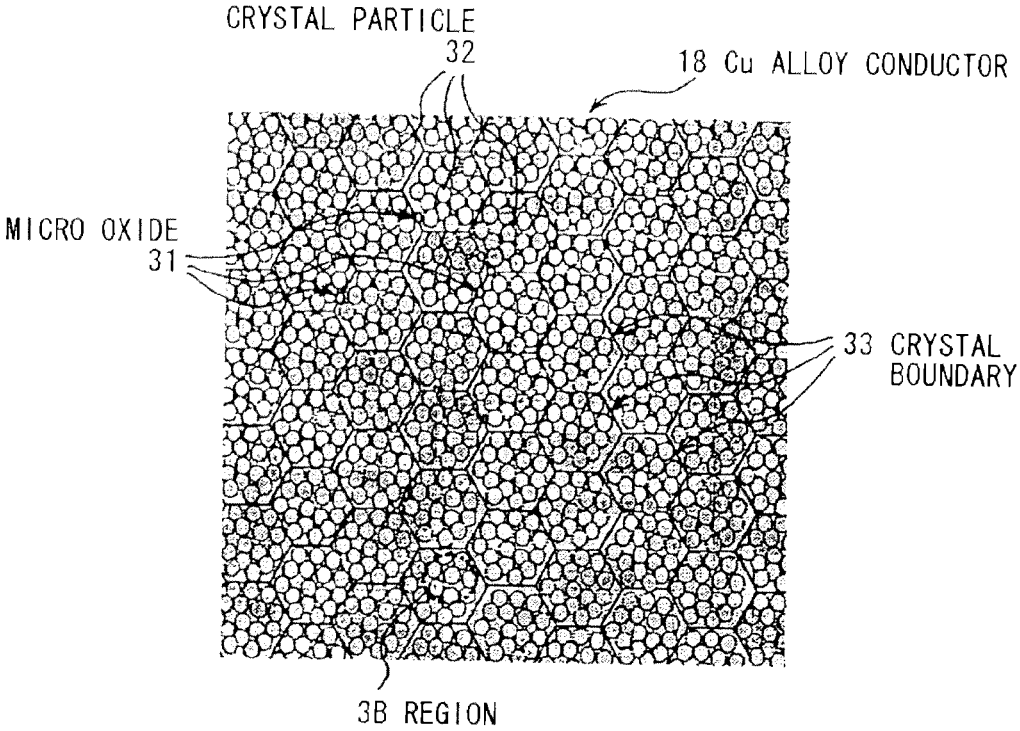
FIG. 3A is a pattern diagram showing a crystal structure in the Cu alloy conductor in the first preferred embodiment according to the present invention.
Figure 3B:
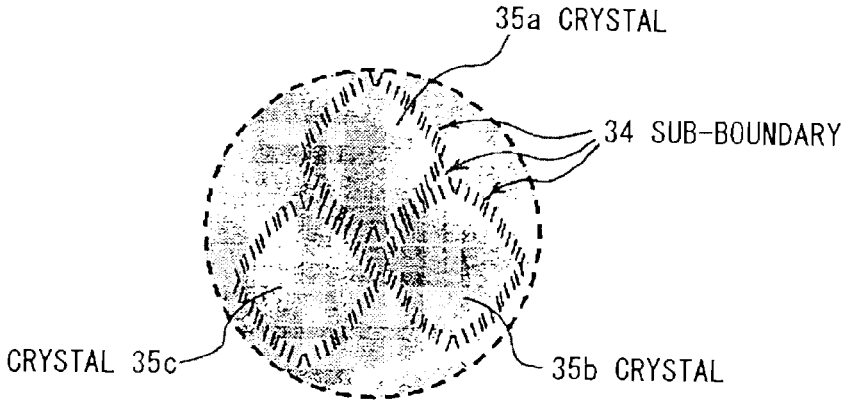
FIG. 3B is a partial enlarged view showing a region 3B in FIG. 3A.

FIG. 3A shows a Cu alloy conductor 18 of the preferred embodiment formed as described above. In the Cu alloy conductor 18, as compared to the conventional Cu alloy conductor 40, the crystal structure is more microscopic, namely an average particle diameter of the crystal particle 32 of the Cu alloy conductor 18 is smaller than an average particle diameter of the crystal particle 41 of the conventional Cu alloy conductor 40, and 100 μm or less. And in a matrix of the Cu alloy conductor 18 80% or more of the oxides affinity with oxygen of which is the largest among additive elements 13 are dispersed in the crystal boundary 33 of each crystal particle 32 as micro oxides 31 having an average particle diameter equal to or less than 1 μm. Further, FIG. 3B is a partial enlarged view of a region 3B in FIG. 3A. In FIG. 3B, a micro sub-boundary is formed inside the crystal particle 32.

This sub-boundary 34 and the micro oxides 31 dispersed in the crystal boundary 33 restrict movement of crystals 35*a*-35*c* and the crystal boundary 33 where the crystals 35*a*-35*c* have a slightly different direction.

As a result, since growth of each crystal 35*a*-35*c* and each crystal particle 32 during hot rolling is restricted, the crystal structure of the rolling material 16 becomes extremely small.

As described above, strength of the Cu alloy conductor 18 of the preferred embodiment is due to an improvement in strength of the Cu alloy conductor based upon miniaturization of the crystal particle 32 and dispersion of the micro oxides 31 into the matrix. Deterioration of the conductivity can be restricted as compared to strength based only upon dissolution strength of Sn described in Japanese Unexamined Patent Publication No. 6-240426. Therefore, according to a manufacturing method of the preferred embodiment a Cu alloy conductor 18 with high tension strength can be provided without large deterioration of the conductivity. Namely, as described in a later-described examples, a Cu alloy conductor 18 with high conductivity equal to or more than 60% IACS, and also high tension strength equal to or more than 420 MPa required for a high-tension overhead wire can be provided.

And since in a manufacturing method of the preferred embodiment an existing or conventional continuous casting rolling facility, or a cold work device can be used, an investment for a new facility is not required and accordingly a Cu alloy conductor 18 with high conductivity and high tension strength can be manufactured at a low cost.

And by using a Cu alloy conductor 18 produced based upon a manufacturing method of the preferred embodiment, a single wire material or a twisted wire material is formed. A cable (a wiring material, a feeding material) 18 with high conductivity and high tension can be obtained by disposing a insulating layer around the single wire material or the twisted wiring material.

As described above, needless to say, the present invention is not limited to the preferred embodiment, and other various modifications are assumed.

Next, the present invention will be explained based upon examples, but is not limited to these examples.

Example 1

39 kinds of Cu alloy conductors each having a diameter Ø of 23 mm (Cu alloy conductor roughing wire for a train wire) are manufactured by changing a kind and an amount of additive elements added to a Cu matrix, and a final rolling temperature of a hot rolling work. A Cu alloy conductor was manufactured by using a method of manufacturing the Cu alloy conductor according to the present invention.

Examples 1-3

Each of the Cu alloy conductors was made by using the Cu alloy conductor in which Sn of 0.3 weight % and In of 0.05, 0.1, or 0.1 weight % were added to each Cu matrix containing an oxygen of 10, 350, or 350 weight ppm. A final rolling temperature of each was 560° C.

Examples 4-24

Each of the Cu alloy conductors was made by using the Cu alloy conductor in which Sn of 0.3 weight % and at least one kind of the additive element of 0.05-0.45 weight % to be selected out of Ca, Mg, Li, Al, Ti, Si, V, Mn, Zn, In, or Ag were added to each Cu matrix containing an oxygen of 350 weight ppm. A final rolling temperature of each was 560° C. The example 5 further contains P of 0.0002 weight % and the example 6 further contains P of 0.090 weight %. The example 7 further contains P of 0.0015 weight % and the example 8 further contains P of 0.0090 weight %.

Examples 25, 26

Each of the Cu alloy conductors was made by using the Cu alloy conductor in which Sn of 0.3 weight % and In of 0.5 weight % were added to each Cu matrix containing an oxygen of 400 or 410 weight ppm. A final rolling temperature of each was 560° C. The example 25 further contains P of 0.0038 weight %.

Conventional Examples 1-5

Each of the Cu alloy conductors was made by using the Cu alloy conductor in which Sn of 0.3 weight % was added to each Cu matrix containing an oxygen of 350 weight ppm. A final rolling temperature of each was 620° C., 600° C., 580° C., 500° C., and 480° C.

Conventional Examples 6-12

Each of the Cu alloy conductors was made by using the Cu alloy conductor in which Sn of 0.3 weight % was added to each Cu matrix containing an oxygen of 5, 10, 30, 400, 800, 1000, or 1200 weight ppm. A final rolling temperature of each was 560° C. Note that since oxygen free high conductivity copper does not contain oxygen, a Cu alloy conductor using the oxygen free high conductivity copper was not used as a Cu matrix.

Conventional Example 13

A Cu alloy conductor was made by using the Cu alloy conductor in which Sn of 0.3 weight % and In of 0.6 weight % were added to the Cu matrix containing an extremely slight amount of oxygen as much as unmeasurable. A final rolling temperature was 560° C.

TABLE 1

(UNIT: WEIGHT %)

| | | O WEIGHT PPM | Sn | Ca | Mg | Li | Al | Ti | Si | V | Mn | Zn | In | Ag | P | B | FINAL ROLLING TEMPERATURE |
|---|---|---|---|---|---|---|---|---|---|---|---|---|---|---|---|---|---|
| EXAMPLE | 1 | 10 | 0.3 | — | — | — | — | — | — | — | — | — | 0.05 | — | — | — | 560° C. |
| | 2 | 350 | 0.3 | — | — | — | — | — | — | — | — | — | 0.1 | — | — | — | 560° C. |
| | 3 | 1000 | 0.3 | — | — | — | — | — | — | — | — | — | 0.1 | — | — | — | 560° C. |
| | 4 | 350 | 0.3 | — | — | — | — | — | — | — | — | — | 0.2 | — | — | — | 560° C. |
| | 5 | 350 | 0.3 | — | — | — | — | — | — | — | — | — | 0.2 | — | 0.0002 | — | 560° C. |
| | 6 | 350 | 0.3 | — | — | — | — | — | — | — | — | — | 0.2 | — | 0.0090 | — | 560° C. |
| | 7 | 350 | 0.3 | — | — | — | — | — | — | — | — | — | 0.2 | — | — | 0.0015 | 560° C. |
| | 8 | 350 | 0.3 | — | — | — | — | — | — | — | — | — | 0.2 | — | — | 0.0090 | 560° C. |
| | 9 | 350 | 0.3 | 0.05 | — | — | — | — | — | — | — | — | — | — | — | — | 560° C. |
| | 10 | 350 | 0.3 | — | 0.05 | — | — | — | — | — | — | — | — | — | — | — | 560° C. |
| | 11 | 350 | 0.3 | — | — | 0.05 | — | — | — | — | — | — | — | — | — | — | 560° C. |
| | 12 | 350 | 0.3 | — | — | — | 0.05 | — | — | — | — | — | — | — | — | — | 560° C. |
| | 13 | 350 | 0.3 | — | — | — | — | 0.05 | — | — | — | — | — | — | — | — | 560° C. |
| | 14 | 350 | 0.3 | — | — | — | — | — | 0.05 | — | — | — | — | — | — | — | 560° C. |

TABLE 1-continued (UNIT: WEIGHT %)

| | | O WEIGHT PPM | Sn | Ca | Mg | Li | Al | Ti | Si | V | Mn | Zn | In | Ag | P | B | FINAL ROLLING TEMP-ERATURE |
|---|---|---|---|---|---|---|---|---|---|---|---|---|---|---|---|---|---|
| | 15 | 350 | 0.3 | — | — | — | — | — | — | 0.05 | — | — | — | — | — | — | 560° C. |
| | 16 | 350 | 0.3 | — | — | — | — | — | — | — | 0.05 | — | — | — | — | — | 560° C. |
| | 17 | 350 | 0.3 | — | — | — | — | — | — | — | — | 0.05 | — | — | — | — | 560° C. |
| | 18 | 350 | 0.3 | — | — | — | — | — | — | — | — | — | 0.05 | 0.05 | — | — | 560° C. |
| | 19 | 350 | 0.3 | — | — | — | — | — | — | — | — | — | — | 0.05 | — | — | 560° C. |
| | 20 | 350 | 0.3 | — | 0.05 | — | — | — | — | — | — | — | 0.1 | — | — | — | 560° C. |
| | 21 | 350 | 0.3 | 0.05 | — | — | — | — | — | — | — | — | 0.1 | — | — | — | 560° C. |
| | 22 | 350 | 0.3 | — | 0.05 | — | — | — | — | — | — | — | 0.4 | — | — | — | 560° C. |
| | 23 | 350 | 0.3 | — | — | — | — | — | — | — | — | — | 0.4 | 0.05 | — | — | 560° C. |
| | 24 | 350 | 0.3 | — | — | — | — | — | — | — | — | — | 0.1 | 0.05 | — | — | 560° C. |
| | 25 | 400 | 0.3 | — | — | — | — | — | — | — | — | — | 0.5 | — | 0.0038 | — | 570° C. |
| | 26 | 410 | 0.3 | — | — | — | — | — | — | — | — | — | 0.5 | — | — | — | 560° C. |
| CONVEN-TIONAL EXAMPLE | 1 | 350 | 0.3 | — | — | — | — | — | — | — | — | — | — | — | — | — | 620° C. |
| | 2 | 350 | 0.3 | — | — | — | — | — | — | — | — | — | — | — | — | — | 600° C. |
| | 3 | 350 | 0.3 | — | — | — | — | — | — | — | — | — | — | — | — | — | 580° C. |
| | 4 | 350 | 0.3 | — | — | — | — | — | — | — | — | — | — | — | — | — | 500° C. |
| | 5 | 350 | 0.3 | — | — | — | — | — | — | — | — | — | — | — | — | — | 480° C. |
| | 6 | 5 | 0.3 | — | — | — | — | — | — | — | — | — | — | — | — | — | 560° C. |
| | 7 | 10 | 0.3 | — | — | — | — | — | — | — | — | — | — | — | — | — | 560° C. |
| | 8 | 30 | 0.3 | — | — | — | — | — | — | — | — | — | — | — | — | — | 560° C. |
| | 9 | 400 | 0.3 | — | — | — | — | — | — | — | — | — | — | — | — | — | 560° C. |
| | 10 | 800 | 0.3 | — | — | — | — | — | — | — | — | — | — | — | — | — | 560° C. |
| | 11 | 1000 | 0.3 | — | — | — | — | — | — | — | — | — | — | — | — | — | 560° C. |
| | 12 | 1200 | 0.3 | — | — | — | — | — | — | — | — | — | — | — | — | — | 560° C. |
| | 13 | INCAP-ABLE MEASURE-MENT | 0.3 | — | — | — | — | — | — | — | — | — | 0.6 | — | — | — | 580° C. |

Table 1 shows manufacturing conditions of Cu alloy conductors for the examples 1-26 and the conventional examples 1-13.

Next, the trolley wires having a cross sectional area of 170 $mm^2$ shown in FIG. 2 were made by using the Cu alloy conductors for the examples 1-26 and the conventional examples 1-13.

Table 2 shows tension strength (MPa), conductivity, ratio of oxygen, existence of sub-boundary, size of crystal particle, surface quality, hot rolling property, and evaluation result for each trolley wire.

With regard to conductivity, "OK" means that the conductivity is 60-90% IACS and "NG" means that the conductivity is less than 60%.

With regard to a ratio of oxide, "OK" means that a ratio of oxide having an average particle diameter equal to or less than 1 μm is equal to or more than 80% and "NG" means that a ratio of oxide having an average particle diameter equal to or less than 1 μm is less than 80%.

With regard to existence of sub-boundary, "OK" means that the sub-boundary is observed in the crystal particle and "NG" means that the sub-boundary is not observed therein.

With regard to size of crystal particle, assuming that an average particle diameter of crystal particles for a trolley wire is set as 1, "OK" means that the size of the crystal particle is less than 0.5, and "NG" means that the size of the crystal particle is 0.5-1.

With regard to surface quality, "OK" means that a few surface flaws exist after hot rolling and "NG" means that many surface flaws exist after hot rolling.

With regard to hot rolling property, "OK" means that hot rolling property is good and "NG" means that hot rolling property is bad.

With regard to evaluation result, "OK" means a good example and "NG" means a defect example.

TABLE 2

| | | TENSION STRENGTH (MPa) | CONDUCTIVITY | RATIO OF OXIDE | EXISTENCE OF SUB-BOUNDARY | SIZE OF CRYSTAL PARTICLE | SURFACE QUALITY | HOT ROLLING PROPERTY | EVALUATION RESULT |
|---|---|---|---|---|---|---|---|---|---|
| EXAMPLE | 1 | 430 | OK | OK | OK | OK | OK | OK | OK |
| | 2 | 442 | OK | OK | OK | OK | OK | OK | OK |
| | 3 | 437 | OK | OK | OK | OK | OK | OK | OK |
| | 4 | 442 | OK | OK | OK | OK | OK | OK | OK |
| | 5 | 443 | OK | OK | OK | OK | OK | OK | OK |
| | 6 | 443 | OK | OK | OK | OK | OK | OK | OK |
| | 7 | 447 | OK | OK | OK | OK | OK | OK | OK |
| | 8 | 448 | OK | OK | OK | OK | OK | OK | OK |
| | 9 | 440 | OK | OK | OK | OK | OK | OK | OK |
| | 10 | 445 | OK | OK | OK | OK | OK | OK | OK |
| | 11 | 442 | OK | OK | OK | OK | OK | OK | OK |
| | 12 | 449 | OK | OK | OK | OK | OK | OK | OK |

TABLE 2-continued

| | | TENSION STRENGTH (MPa) | CONDUCTIVITY | RATIO OF OXIDE | EXISTENCE OF SUB-BOUNDARY | SIZE OF CRYSTAL PARTICLE | SURFACE QUALITY | HOT ROLLING PROPERTY | EVALUATION RESULT |
|---|---|---|---|---|---|---|---|---|---|
| | 13 | 446 | OK | OK | OK | OK | OK | OK | OK |
| | 14 | 445 | OK | OK | OK | OK | OK | OK | OK |
| | 15 | 445 | OK | OK | OK | OK | OK | OK | OK |
| | 16 | 447 | OK | OK | OK | OK | OK | OK | OK |
| | 17 | 440 | OK | OK | OK | OK | OK | OK | OK |
| | 18 | 445 | OK | OK | OK | OK | OK | OK | OK |
| | 19 | 441 | OK | OK | OK | OK | OK | OK | OK |
| | 20 | 448 | OK | OK | OK | OK | OK | OK | OK |
| | 21 | 447 | OK | OK | OK | OK | OK | OK | OK |
| | 22 | 448 | OK | OK | OK | OK | OK | OK | OK |
| | 23 | 451 | OK | OK | OK | OK | OK | OK | OK |
| | 24 | 447 | OK | OK | OK | OK | OK | OK | OK |
| | 25 | 518 | OK | OK | OK | OK | OK | OK | OK |
| | 26 | 514 | OK | OK | OK | OK | OK | OK | OK |
| CONVENTIONAL EXAMPLE | 1 | 410 | OK | NG | NG | NG | OK | OK | NG |
| | 2 | 415 | OK | NG | OK | NG | OK | OK | NG |
| | 3 | 417 | OK | NG | OK | NG | OK | OK | NG |
| | 4 | 420 | OK | NG | OK | NG | OK | OK | NG |
| | 5 | 421 | OK | NG | OK | NG | NG | OK | NG |
| | 6 | 410 | OK | NG | OK | NG | OK | OK | NG |
| | 7 | 410 | OK | NG | OK | NG | OK | OK | NG |
| | 8 | 412 | OK | NG | OK | NG | OK | OK | NG |
| | 9 | 415 | OK | NG | OK | NG | OK | OK | NG |
| | 10 | 418 | OK | NG | OK | NG | OK | OK | NG |
| | 11 | 420 | OK | NG | OK | NG | OK | OK | NG |
| | 12 | — | — | NG | OK | NG | OK | NG | NG |
| | 13 | — | — | — | — | — | — | — | NG |

Table 2 shows evaluation results for examples 1-26 and conventional examples 1-13 in terms of the required properties. each trolley wire produced by using each Cu alloy conductor for the examples 1-26 had a tension strength equal to or more than 420 MPa and a conductivity equal to or more than 60% IACS. In each trolley wire, a ratio of oxides having an average particle diameter equal to or less than 1 μm was equal to or more than 80% and the sub-boundary was observed in the crystal particle and the size of the crystal particle was less than 0.5. Further, each trolley wire showed a few surface flaws, a good surface quality, and a good hot rolling property. In particular, in the cases of the examples 25, 26 containing In of 0.5 weight % as an additive element, a high tension strength exceeding 500 MPa was produced and the evaluation result of each was also good.

On the other hand, each trolley wire produced by using each Cu alloy conductor for the conventional examples 1-5, since each Cu matrix did not contain an additive element, showed a few ratios of the micro oxides and large crystal particles only. And although the conductivity was good, the tension strength was less than 420 MPa except for the conventional examples 4, 5. In particular, in the case of the conventional example 1, since the final rolling temperature was too high, the dislocation introduced during rolling was not rearranged, and the sub-boundary was not formed. Accordingly the tension strength was the smallest among the conventional examples 1-5. In the case of the conventional example 5, since the final rolling temperature was too low, many flaws were generated on the trolley wire surface and the surface quality was bad. Therefore, the evaluation result of each of the conventional examples 1-5 was no good.

And each trolley wire produced by using each Cu alloy conductor for the conventional examples 6-12, since the oxygen content and Sn content were within the range of the present invention, but the Cu matrix did not contain the additive element, had a small ratio of micro oxides and large crystal particles only. And the conductivity was good, but the tension strength was less than 420 MPa in the conventional examples other than the conventional example 11. In particular, in the case of the conventional example 12, due to too many oxygen contents the hot rolling property was bad. Therefore, the evaluation result for each of the conventional examples 6-12 was bad.

Further, the trolley wire produced by using each Cu alloy conductor for the conventional example 13 had a high hardness, since Sn content and the final rolling temperature were within the range of the present invention, but the ratio of the additive elements added to the Cu alloy conductor was too many. As a result, a load in the hot rolling became extremely high to make it impossible to manufacture the rolling material.

Example 2

A structure observation was made with regard to each Cu alloy conductor for the example 2 and the conventional example 1 in Example 1. The structure observation was made by using an optical microscope, SEM (scanning electron microscope), and TEM (transmission electron microscope).

Figure 5A:
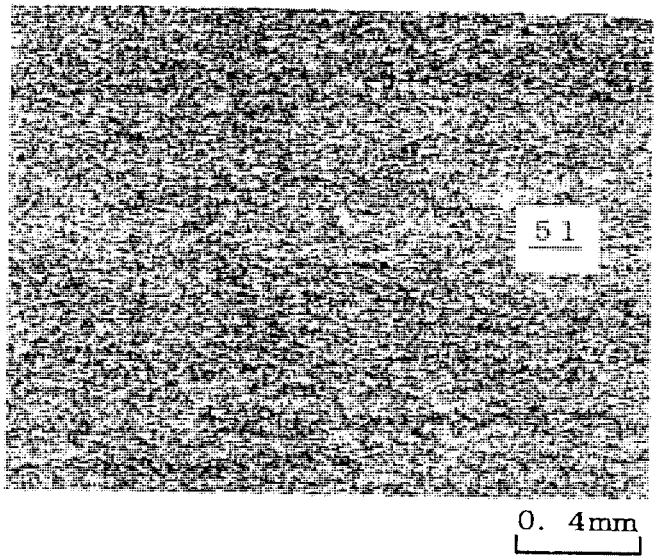
FIG. 5A is an optical microscope observation view showing a crystal structure in a Cu alloy conductor in an example 2.
Figure 5B:
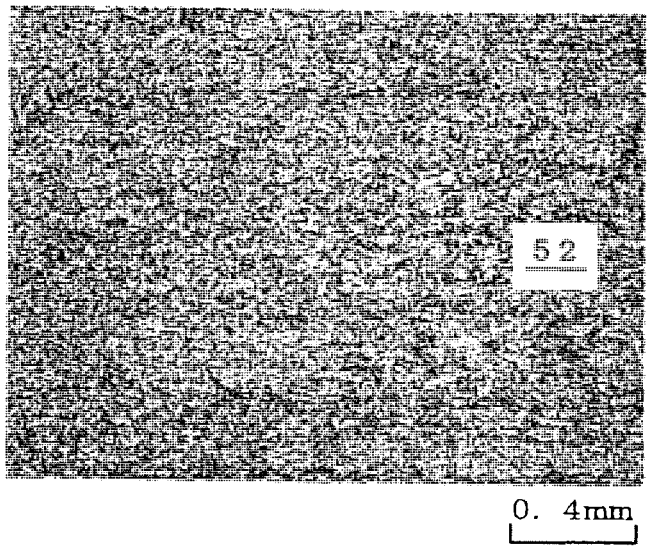
FIG. 5B is an optical microscope observation view showing a crystal structure in a Cu alloy conductor in a conventional example 1.
Figure 6A:
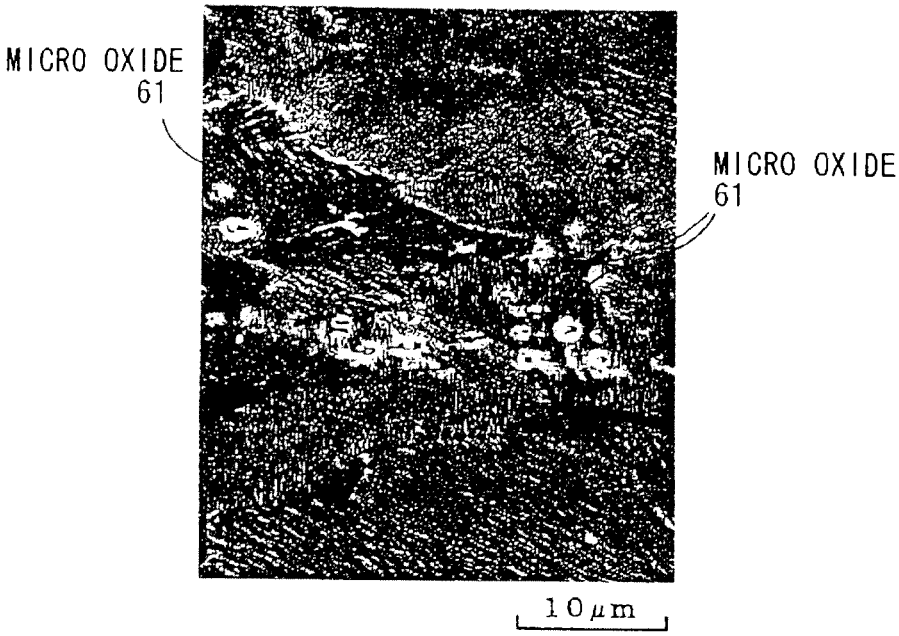
FIG. 6A is an SEM observation view showing the crystal structure in the Cu alloy conductor in the example 2.
Figure 6B:
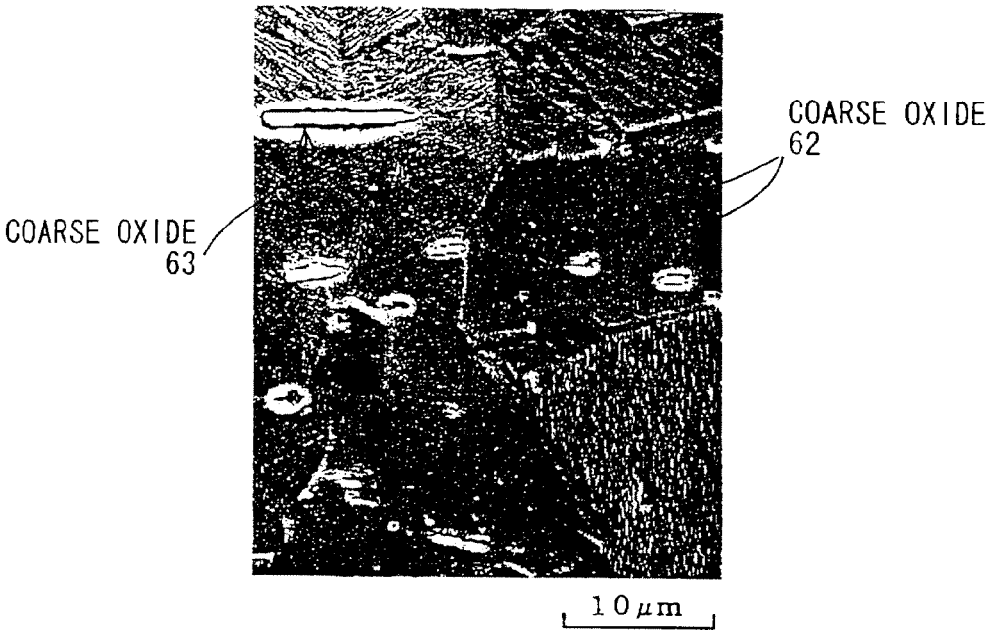
FIG. 6B is an SEM observation view showing the crystal structure in the Cu alloy conductor in the conventional example 1.

FIG. 5A and FIG. 5B respectively show the crystal structures 51 and 52. The crystal particle size of the crystal structure 51 in the Cu alloy conductor of the example 2 shown in FIG. 5A was microscopic as compared to the crystal particle size of the crystal structure 52 in the Cu alloy conductor of the conventional example 1 shown in FIG. 5B. When an average particle diameter of the crystal particle of the crystal structure 52 was set as 1, the crystal particle size of the crystal structure 51 was less than approximately 0.5. FIG. 6A and FIG. 6B respectively show the oxides 61 and 62. Oxides ($SnO_2$) in the Cu alloy conductor of conventional 1 shown in FIG. 6B were composed of many coarse oxides having an average particle diameter equal to or more than 1 μm and some of them were coarse oxides having a particle diameter 10 μm or more. On the other hand, almost all oxides ($In_2O_3$) in the Cu alloy conductor of the example 2 shown in FIG. 6A were composed of micro oxides having an average particle diameter less than 1 μm.

Figure 7A:
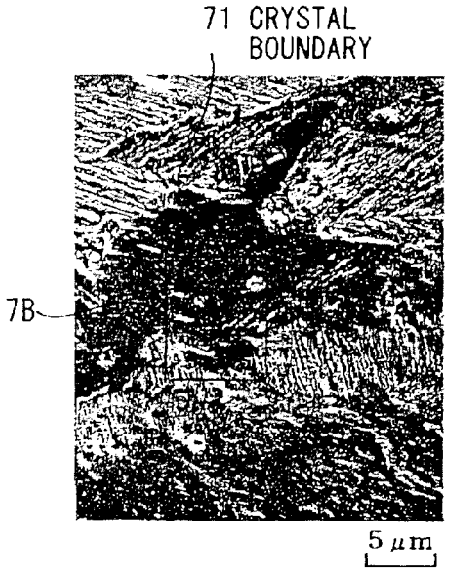
FIG. 7A is the SEM observation view showing the crystal structure in the Cu alloy conductor in the example 2.
Figure 7B:
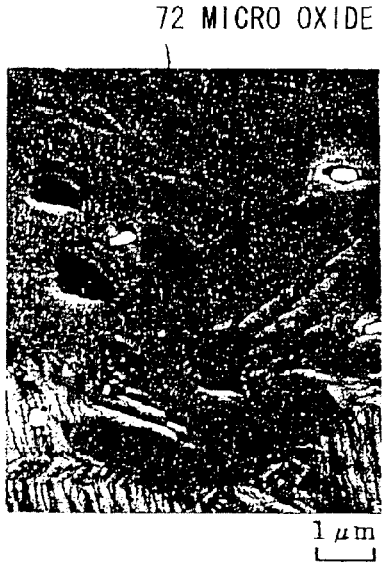
FIG. 7B is an enlarged view of an area 7B in FIG. 7A.
Figure 7C:
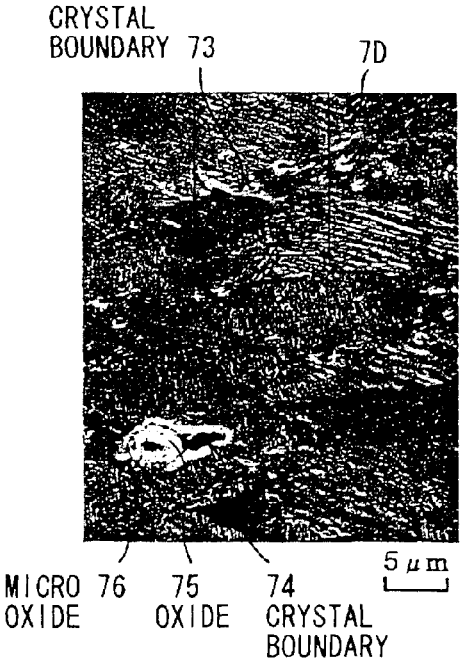
FIG. 7C is the SEM observation view showing the crystal structure in the Cu alloy conductor in the example 2.
Figure 7D:
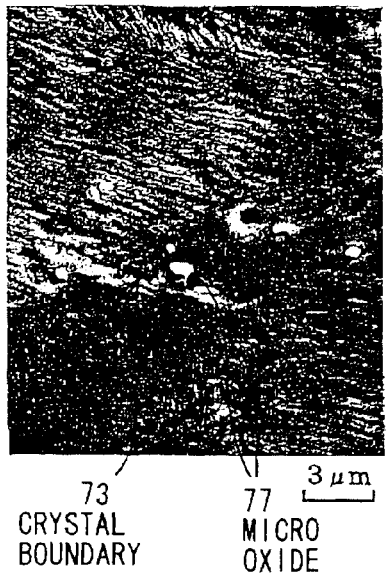
FIG. 7D is an enlarged view of an area 7D in FIG. 7C.

From a more detailed observation on the Cu alloy conductor in the example 2, as shown in FIGS. 7A and 7B, some portions of the surface of the crystal boundary 71 were exposed by etching where the micro oxides ($In_2O_3$) were crystallized by priority. And as shown in FIGS. 7C and 7D, micro oxides 76, 77 were observed even in the crystal boundaries 73, 74 in the crystal structure. The oxides 75 having an average particle diameter more than 1 μm observed in FIG. 7C were Sn oxides ($SnO_2$) and the dispersion amount was very smaller as compared to the dispersion amount of each micro oxide 72, 76, and 77. Namely most of the oxides dispersed in the crystal structure were In oxides having a larger affinity with oxygen than that of Sn and were dispersed in the crystal boundaries 71, 73, and 74.

Figure 8A:
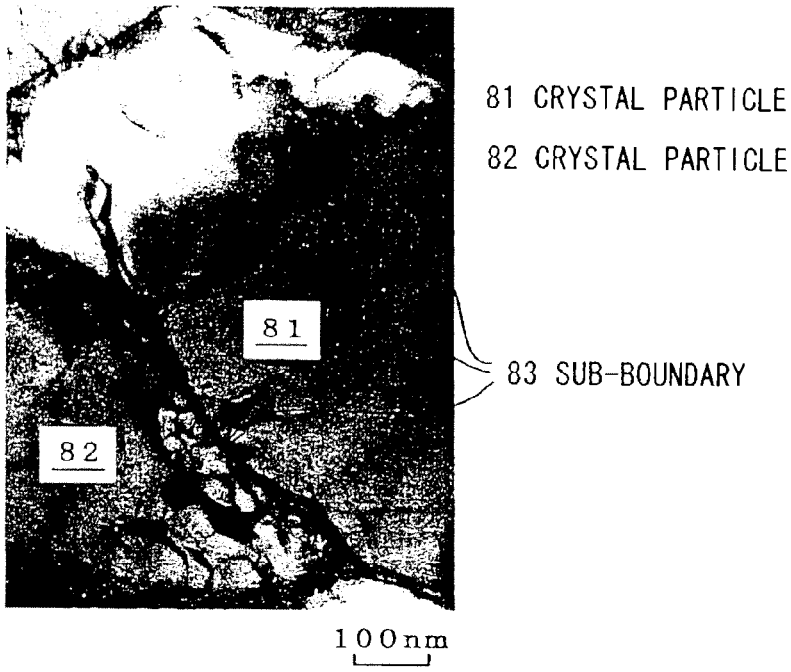
FIG. 8A is a TEM observation view showing the crystal structure in the Cu alloy conductor in the example 2.
Figure 8B:
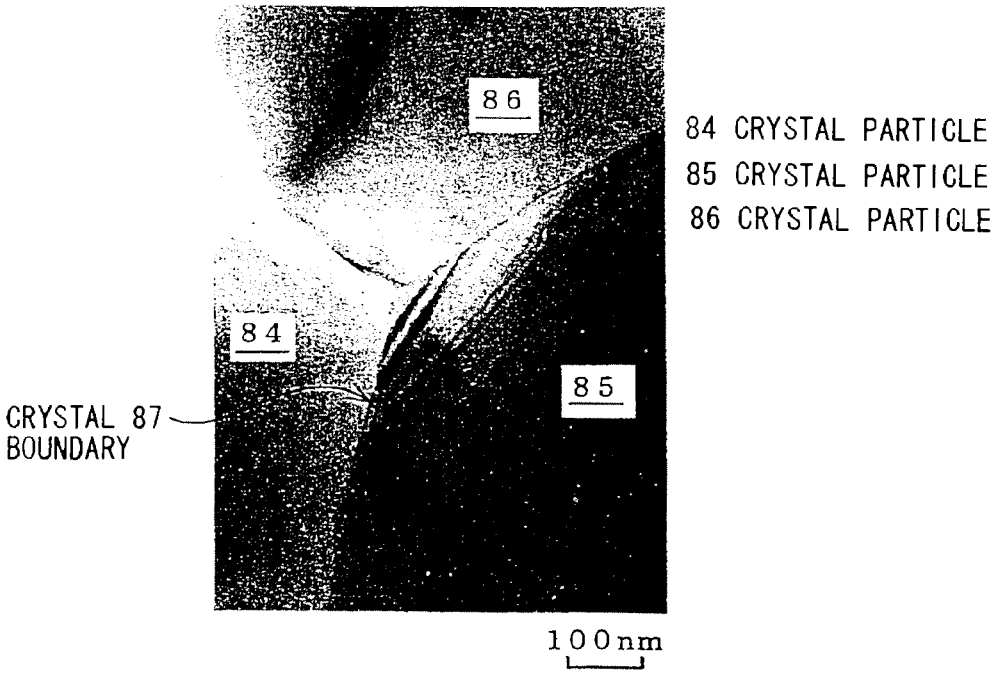
FIG. 8B is a TEM observation view showing the crystal structure in the Cu alloy conductor in the conventional example 1.

FIGS. 8A and 8B respectively show a crystal structure of the Cu alloy conductor in the example 2 and a crystal structure of the Cu alloy conductor in the conventional example 1. In the crystal structure in FIG. 8B, the sub-boundary was observed in each crystal particle 81, 82. On the other hand, in the crystal structure in FIG. 8A, only the crystal boundary 87 was observed and the sub-boundary was not observed in each crystal particle 84-86. The hardness in example 2 was twice the hardness in the conventional example 1 due to the existence of the sub-boundary 83, namely the Cu alloy conductor in the example 2 was harder than that in the conventional example 1. That is, it is thought that high hardness of the crystal particle due to the sub-boundary 83 contributes to an improvement of tension strength in the Cu alloy conductor.

Second Preferred Embodiment

Figure 9:
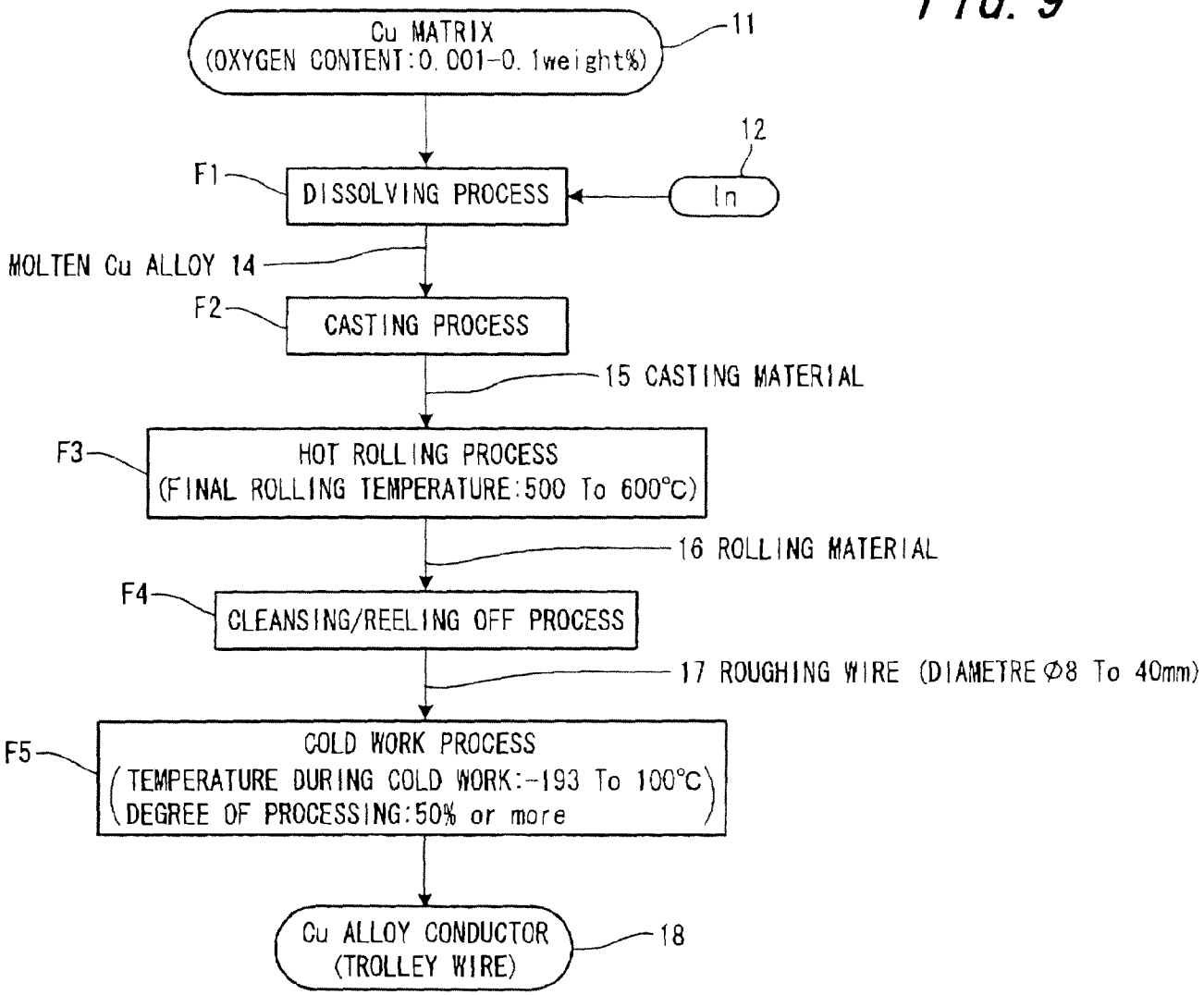
FIG. 9 is a flow chart showing a manufacturing process of a Cu alloy conductor in a second preferred embodiment according to the present invention.

FIG. 9 is a flow chart showing processes (steps) of manufacturing a Cu alloy conductor in a second preferred embodiment of the present invention.

A method of manufacturing a Cu alloy conductor 18 in the second preferred embodiment comprises:

a dissolving process (step) for adding and dissolving In 12 to a Cu matrix 11 to form a molten Cu alloy 14 (F1);

a casting process (step) for casting the molten Cu alloy 14 to form a casting material 15 (F2);

a hot rolling process (step) for performing a plurality of hot rolling processes to the casting material 15 to form a rolled material 16 (F3);

a cleansing/reeling off process (step) for cleansing and then reeling off the rolled material 16 to produce a roughing wire 17 (F4); and a cold work (wire-drawing) process (step) for winding off the reeled roughing wire 17 and performing a cold work to the reeled roughing wire 17 to form a Cu alloy conductor 18 (F5).

The Cu alloy conductor 18 is processed to be a wire material or a plate material in a desired shape in accordance with its application. An existing or a conventional continuous casting rolling facility (SCR continuous casting machine) can be applied from the dissolving process (F1) to the cleansing/reeling off process (F4). And an existing or a conventional cold work machine can be applied to the cold work step (F5).

The method of manufacturing the Cu alloy conductor 18 will be explained in more detail as follows.

First, in the dissolving process (F1), In 12 of 0.1-0.7 weight %, preferably 0.2-0.6 weight %, further preferably 0.3-0.5 weight % is added and dissolved to a Cu matrix containing oxygen of 0.001-0.1 weight % (10-1000 weight ppm) to form a molten Cu alloy. The In 12 is oxidized and is generated and dispersed as In oxide ($In_2O_3$) in a crystal structure of the Cu alloy conductor 18 to be finally obtained. Most (80% or more) of the In oxides are micro oxides having an average particle diameter equal to or less than 1 μm. The Cu matrix may contain obligatory impurities.

In a case where a content of the In 12 is less than 0.1 weight %, even if the manufacturing method according to the preferred embodiment is applied, an improvement in strength of the Cu alloy conductor is not achieved. And in a case where the content of the In 12 goes beyond 0.7 weight %, hardness of the casting material 15 is increased to increase a deformation resistance during rolling processing. As a result, a load to the rolling work becomes extremely high, which causes difficulty in commercialization of product. As the content of the In increases in the range where the content of the In 12 is 0.1-0.7 weight %, the conductivity gradually deteriorates.

Therefore, in the preferred embodiment the content of the In 12 is appropriately adjusted within the range of 0.1-0.7 weight %. As a result, as will be described in [Example] later, a tension strength of the Cu alloy conductor increases to 420 MPa or more, as well as the conductivity can be adjusted properly within the range of 60-95% IACS, preferably 75-95% IACS, and further preferably 83-95% IACS.

As the content of the In 12 increases, surface flaws of the rolling material 16 tend to increase in hot rolling during the hot rolling step (F3). Accordingly in the case of many contents of the In 12 (for example, 0.5 weight % or more), the In 12, as well as P may be added to the Cu matrix 11 to reduce the surface flaws of the rolling material 16. P is added in a ratio equal to or less than 0.01 weight % (100 weight ppm). when the P content is less than 2 ppm, an effect of reducing the surface flaws of Cu wires is not obtained clearly and on the other hand, when the P content goes beyond 100 weight ppm, conductivity of the Cu alloy conductor 18 reduces.

As the content of the In 12 increases, a crystal particle of the casting material 15 after a casting step (F2) tends to become large in size (as a result, tendency to slight reduction in strength of the Cu alloy conductor 18). Hence, in a case many contents of the In 12 are contained (in the case of 0.5 weight % or more), the In 12, as well as B may be added to the Cu matrix 11 to reduce sizes of crystal particles of the casting material 15 to be extremely small. B is added in a ratio equal to or less than 0.01 weight % (100 weight ppm). when the B content is less than 2 ppm, an effect of reducing the sizes of the crystal particles to be extremely small (as a result, an improvement effect of strength of the Cu alloy conductor 18) can not be obtained sufficiently and on the other hand, the B content goes beyond 100 weight ppm, conductivity of the Cu alloy conductor 18 reduces.

Further, both P and B may be added in a sum of 0.02 weight % (200 weight ppm).

As the oxygen content increases in the range where the oxygen content of the Cu matrix 11 is 0.001-0.1 weight % (10-1000 weight %), both the tension strength and the conductivity gradually improve.

Next, in the casting step (F2) the molten Cu ally 14 obtained in the previous step is provided to an SCR type of continuous casting rolling. In detail, a casting is performed at a temperature lower than a normal casting temperature (1120-1200° C.) in the SCR continuous casting, as well as a casting mold (Cu casting mold) is forcibly cooled, which rapidly cools the casting material 15 to a temperature at least 15° C. lower than a solidification temperature of the molten Cu alloy 14.

By these casting treatment and rapid cooling treatment, a size of oxides crystallized (or precipitated) in the casting material 15 and a crystal particle size of the casting material 15 are respectively smaller as compared to a case where a casting is performed at a normal casting temperature or where the casting material 15 is cooled only to a temperature exceeding a solidification temperature −15° C. of the molten Cu alloy 14.

Next, in the hot rolling step (F3) a temperature of the casting material 15 is controlled to a temperature 50-100° C. lower than a normal rolling temperature during continuous casting rolling, namely a temperature equal to or less than 900° C., preferably 750-900° C. In the state a plurality of hot rolling processes are performed to the casting material 15 and in a final rolling step a hot rolling work is performed at a temperature of from 500 to 600° C. to form the rolled material. When the final rolling temperature is less than 500° C., many surface flaws are produced during the rolling process, which causes deterioration of surface quality in the casting material 15. When the final rolling temperature is more than 600° C., the crystal structure becomes a rough structure in the same level as the conventional structure. Herein as the final rolling temperature increases in the range where the final rolling temperature is 500-600° C., the tension strength gradually decreases, but the conductivity gradually increases.

Due to the hot rolling the oxides in a relatively small size crystallized (or precipitated) in the previous step are separated, thereby to reduce the size of the oxides smaller. And since the hot rolling process in the manufacturing method according to the present embodiment is performed at a temperature lower than in a normal hot rolling, the dislocation introduced during the rolling is rearranged to form a very small sub-boundary in the crystal particle. A sub-boundary is a boundary between a plurality of crystals existing in the crystal particle a direction of which is a little different.

Next, in the cleansing/reeling off step (F4) the rolling material 16 is cleansed and reeled off to form the roughing wire 17. A wire diameter of the reeled roughing wire 17 is set as, for example 8-40 mm, preferably equal to or less than 30 mm. For example, a wire diameter of the roughing wire 17 for a trolley line is set as 22-30 mm.

Finally, in a cold work step, the reeled wire 17 is wound off and a cold work (wire processing) is performed at a temperature of −193 (liquid nitrogen temperature)-100° C., preferably less than −193-25° C. Thereby, the Cu alloy conductor 18 is formed. Herein, in order to reduce an influence (deterioration of strength) of heat generated during a continuous wiring on the Cu alloy conductor 18, cooling a cold work device such as a drawing die is performed, to adjust a wire material temperature to be equal to or less than 100° C., preferably 25° C. or less. And in order to improve the strength of the Cu alloy conductor 18, it is necessary to sufficiently increase the strength of the rolling material 16, namely the roughing wire 17, by increasing the degree of processing in a hot rolling work. Besides, the degree of processing is required to be equal to or more than 50%. When the degree of processing is less than 50%, tension strength exceeding 420 MPa cannot be obtained.

The Cu alloy conductor 18 produced is formed to be in a desired shape suitable for its use, for example a train wire (trolley wire). A cross sectional area of the train wire is, for example, 110-170 $mm^2$.

Next, operations of the preferred embodiment will be explained.

A crystal structure of a conventional Cu alloy conductor is coarse. And an oxide such as Sn is a coarse oxide 42 having an average particle diameter (or length) more than 1 μm. As a result, the tension strength of the conventional Cu alloy conductor is not sufficient.

On the other hand, in a method of manufacturing a Cu alloy conductor 18 according to the preferred embodiment, the In 12 of 0.1-0.7 weight % is added to a Cu matrix 11 to form a molten Cu alloy 14. Thereafter, a continuous casting at a low temperature (a casting temperature of 1100-1150° C.), a low temperature rolling work (a final rolling temperature of 500-600° C.), and a cold work at a temperature adjusted to be equal to or less than 100° C. to avoid an influence of work heat are performed to the molten Cu alloy 14 to form the Cu alloy conductor 18.

In the Cu alloy conductor 18, as compared to the conventional Cu alloy conductor, the crystal structure is more microscopic, namely an average particle diameter of the crystal particle of the Cu alloy conductor 18 is smaller than an average particle diameter of the crystal particle of the conventional Cu alloy conductor, and 100 μm or less. And in a matrix of the Cu alloy conductor 18 the In 12 oxides are dispersed and 80% or more of the In 12 oxides is micro oxides having an average particle diameter equal to or less than 1 μm.

The micro oxides dispersed in the matrix restricts movement of crystals and the crystal boundary due to heat (sensible heat) that the casting material 15 owns. As a result, since growth of each crystal particle 32 during hot rolling is restricted, the crystal structure of the rolling material 16 becomes extremely small.

As a result, strength of the Cu alloy conductor 18 of the preferred embodiment is due to an improvement in strength of the Cu alloy conductor based upon miniaturization of the crystal particle and dispersion of the micro oxides into the matrix. Deterioration of the conductivity can be restricted as compared to strength based only upon dissolution strength of Sn described in Japanese Unexamined Patent Publication No. 6-240426. Therefore, according to a manufacturing method of the preferred embodiment a Cu alloy conductor 18 with high tension strength can be provided without large deterioration of the conductivity. Namely, as described in a later-described examples, a Cu alloy conductor 18 (trolley wire) with high conductivity equal to or more than 60% IACS, and also high tension strength equal to or more than 420 MPa required for a high-tension overhead wire can be provided.

And since in a manufacturing method of the preferred embodiment an existing or conventional continuous casting rolling facility, or a cold work device can be used, an investment for a new facility is not required and accordingly a Cu alloy conductor 18 with high conductivity and high tension strength can be manufactured at a low cost.

And by using a Cu alloy conductor 18 produced based upon a manufacturing method of the preferred embodiment, a single wire material or a twisted wire material is formed. A cable (a wiring material, a feeding material) 18 with high conductivity and high tension can be obtained by disposing a insulating layer around the single wire material or the twisted wiring material.

As described above, needless to say, the present invention is not limited to the preferred embodiment, and other various modifications are assumed.

Next, the present invention will be explained based upon examples, but is not limited to these examples.

Example

Cu alloy conductors each having a diameter Ø of 23 mm (Cu alloy conductor roughing wire for a train wire) were manufactured by changing a kind and an amount of additive elements added to a Cu matrix, and a final rolling temperature of a hot rolling work. A Cu alloy conductor was manufactured by using a method of manufacturing the Cu alloy conductor according to the present invention.

Examples 1-3

Each of the Cu alloy conductors was produced by using the Cu alloy material in which In of 0.3, 0.4, or 0.6 weight % were added to each Cu matrix containing an oxygen of 10 weight ppm. A final rolling temperature of each was 560° C.

Examples 4-6

Cu alloy conductors were produced the same as the examples 1-3 except that the oxygen content was 350 weight %. The final rolling temperature of each example was 560° C.

Examples 7-9

Cu alloy conductors were produced the same as the examples 1-3 except that the oxygen content was 500 weight %. A final rolling temperature of each example was 560° C.

Conventional Examples 1-3

Cu alloy conductors were produced by using a Cu alloy material in which Sn of 0.3 weight % was added to each Cu matrix containing oxygen of 350 weight ppm. A final rolling temperature of each conventional example was 560° C.

Conventional Example 4

A Cu alloy conductor was produced by using a Cu alloy material in which Sn of 0.3 weight % was added to a Cu matrix containing oxygen of 10 weight ppm. A final rolling temperature was 560° C.

Conventional Example 5

A Cu alloy conductor was produced by using a Cu alloy material in which Sn of 0.3 weight % was added to a Cu matrix containing oxygen of 500 weight ppm. A final rolling temperature was 560° C.

Table 3 shows the manufacturing conditions (oxygen content, kind and content of an additive element, and final rolling temperature) of the examples 1-11 and the conventional examples 1-5.

TABLE 3

| | | O WEIGHT PPM | Sn | In | P | B | FINAL ROLLING TEMPERATURE |
|---|---|---|---|---|---|---|---|
| EXAMPLE | 1 | 10 | — | 0.3 | — | — | 560° C. |
| | 2 | 10 | — | 0.4 | — | — | 560° C. |
| | 3 | 10 | — | 0.6 | — | — | 560° C. |
| | 4 | 350 | — | 0.3 | — | — | 560° C. |
| | 5 | 350 | — | 0.4 | — | — | 560° C. |
| | 6 | 350 | — | 0.6 | — | — | 560° C. |
| | 7 | 500 | — | 0.3 | — | — | 560° C. |
| | 8 | 500 | — | 0.4 | — | — | 560° C. |
| | 9 | 500 | — | 0.6 | — | — | 560° C. |
| | 10 | 350 | — | 0.6 | 0.0050 | — | 560° C. |
| | 11 | 350 | — | 0.6 | — | 0.0050 | 560° C. |
| CONVENTIONAL EXAMPLE | 1 | 350 | 0.3 | — | — | — | 650° C. |
| | 2 | 350 | 0.3 | — | — | — | 600° C. |
| | 3 | 350 | 0.3 | — | — | — | 560° C. |
| | 4 | 10 | 0.3 | — | — | — | 560° C. |
| | 5 | 500 | 0.3 | — | — | — | 560° C. |

(UNIT: WEIGHT %)

Example 10

A Cu alloy conductor was produced by using a Cu alloy material in which In of 0.6 weight % and P of 0.0050 weight % were added to a Cu matrix containing an oxygen of 350 weight ppm. A final rolling temperature was 560° C.

Example 11

A Cu alloy conductor was produced by using a Cu alloy material in which In of 0.6 weight % and B of 0.0050 weight % were added to a Cu matrix containing an oxygen of 350 weight ppm. A final rolling temperature was 560° C.

Next, the trolley wires having a cross sectional area of 170 $mm^2$ were made by using the Cu alloy conductors for the examples 1-11 and the conventional examples 1-5.

Table 3 shows tension strength (MPa), conductivity, a ratio of oxygen, sizes of crystal particles, surface quality, and hot rolling property for each trolley wire.

With regard to a ratio of oxide, "OK" means that a ratio of oxide having an average particle diameter equal to or less than 1 μm is equal to or more than 80% and "NG" means that a ratio of oxide having an average particle diameter equal to or less than 1 μm is less than 80%.

With regard to sizes of crystal particles, assuming that an average particle diameter of crystal particles for a trolley wire is set as 1.0, "OK" means that the size of the crystal particle is less than 0.5, and "NG" means that the size of the crystal particle is 0.5-1. With regard to surface quality, "OK" means that a few surface flaws were generated after hot rolling and "NG" means that many surface flaws were generated after hot rolling.

With regard to hot rolling property, "OK" means that hot rolling property was good and "NG" means that hot rolling property was bad.

TABLE 4

| | | TENSION STRENGTH (MPa) | CONDUCTIVITY (% IACS) | RATIO OF OXIDE | SIZE OF CRYSTAL PARTICLE | SURFACE QUALITY | HOT ROLLING PROPERTY |
|---|---|---|---|---|---|---|---|
| EXAMPLE | 1 | 422 | 90 | OK | OK | OK | OK |
| | 2 | 441 | 85 | OK | OK | OK | OK |
| | 3 | 450 | 78 | OK | OK | OK | OK |
| | 4 | 421 | 92 | OK | OK | OK | OK |
| | 5 | 440 | 87 | OK | OK | OK | OK |
| | 6 | 448 | 80 | OK | OK | OK | OK |
| | 7 | 423 | 94 | OK | OK | OK | OK |
| | 8 | 442 | 89 | OK | OK | OK | OK |
| | 9 | 449 | 82 | OK | OK | OK | OK |
| | 10 | 447 | 79 | OK | OK | OK | OK |
| | 11 | 449 | 80 | OK | OK | OK | OK |
| CONVENTIONAL EXAMPLE | 1 | 410 | 83 | NG | NG | OK | OK |
| | 2 | 415 | 82 | NG | NG | OK | OK |
| | 3 | 417 | 80 | NG | NG | OK | OK |
| | 4 | 416 | 75 | NG | NG | OK | OK |
| | 5 | 417 | 84 | NG | NG | OK | OK |

Table 4 shows the evaluation for the examples 1-11 and the conventional examples 1-5. Each trolley wire produced by using each Cu alloy conductor for the examples 1-11 had a tension strength equal to or more than 420 MPa and a conductivity equal to or more than 60% IACS. In each trolley wire, a ratio of oxides having an average particle diameter equal to or less than 1 μm was equal to or more than 80% and the sub-boundary was observed in the crystal particle and the size of the crystal particle was less than 0.5. Further, each trolley wire showed a few surface flaws, a good surface quality, and a good hot rolling property.

As a result of comparing each trolley wire produced by using each Cu alloy conductor for the examples 1-3, 4-5, and 7-9, it was found that as the In content increases, the tension strength improves, but the conductivity deteriorates.

As a result of comparing each trolley wire produced by using each Cu alloy conductor for the examples 6 and 10, it was found that the example 10 having P shows a better surface quality.

As a result of comparing each trolley wire produced by using each Cu alloy conductor for the examples 6 and 11, it was found that the example 11 having B shows a slightly higher tension strength.

On the other hand, each trolley wire produced by using each Cu alloy conductor for the conventional examples 1-5, since the element added to each Cu matrix was not the In, but the Sn, showed a small ratio of the micro oxides and obtained large crystal particles only. And although the conductivity of each was equal to or more than 75% IACS and was good, the tension strength of each was less than 420 MPa.

As a result of comparing each trolley wire produced by using each Cu alloy conductor for the conventional examples 1-3, it was found that as the final rolling temperature decreases, the tension strength improves, but the conductivity deteriorates. As a result of comparing each trolley wire produced by using each Cu alloy conductor for the conventional examples 3-5, it was found that as the oxygen content increases, both the tension strength and the conductivity improve.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A method of manufacturing a Cu alloy conductor with a rolled casting material formed by continuous casting and rolling using a molten Cu alloy, comprising:

adding and dissolving In of 0.1-0.7 weight % to a Cu matrix containing oxygen of 0.001-0.1 weight % to form the molten Cu alloy having a balance being Cu;

performing a continuous casting with the molten Cu alloy and rapidly quenching a casting material to a temperature at least 15° C. lower than a melting point of the molten Cu alloy such that a size of indium oxides crystallized or precipitated in the casting material and a crystal particle size of the casting material are respectively smaller with respect to casting performed at a normal casting temperature within a range from 1120 to 1200° C.;

controlling the casting material at a temperature equal to or lower than 900° C.;

performing a plurality of hot rolling processes on the casting material such that a temperature of a final hot rolling is within a range from 500 to 600° C. to form the rolled casting material;

forming a roughing wire from the rolled casting material; and performing cold work on the roughing wire at a temperature within a range from −193° C. to 25° C. such that a degree of processing is equal to or greater than 50%, wherein dislocation introduced during rolling is rearranged and a very small sub-boundary is formed in crystal particles, wherein the Cu alloy conductor after the cold work has a crystal structure comprising the crystal particles having an average particle diameter of 100 μm or less, wherein 80% or more of the indium oxides are dispersed as micro oxides having an average particle diameter equal to or less than 1 μm in a matrix of the crystal structure, and wherein the sub-boundary is formed in the crystal particles.

2. The method according to claim 1, further comprising forming the Cu alloy conductor in a train wire.

3. The method according to claim 2, wherein the train wire has a cross sectional area of 110-170 $mm^2$.

4. The method according to claim 2, wherein the train wire has a tension strength that is equal to or more than 420 MPa.

5. The method according to claim 2, wherein the train wire has a conductivity that is equal to or more than 75% IACS.

6. The method according to claim 2, wherein the cross sectional area of the train wire is defined by a first ear groove and a second ear groove opposed to the first ear groove, wherein the first and second ear grooves are disposed above a first arc surface of a train wire body of the train wire and below a second arc surface of the train wire body, and wherein the first arc surface is larger than the second arc surface.

* * * * *